US010446063B2

(12) United States Patent
Yang et al.

(10) Patent No.: US 10,446,063 B2
(45) Date of Patent: Oct. 15, 2019

(54) PROFILED DISPLAY PANEL AND DISPLAY DEVICE

(71) Applicant: XIAMEN TIANMA MICRO-ELECTRONICS CO., LTD., Xiamen (CN)

(72) Inventors: Yan Yang, Xiamen (CN); Binyi Zheng, Xiamen (CN); Yongping Zeng, Xiamen (CN); Ling Wu, Xiamen (CN); Boping Shen, Xiamen (CN)

(73) Assignee: XIAMEN TIANMA MICRO-ELECTRONICS CO., LTD., Xiamen (CN)

( * ) Notice: Subject to any disclaimer, the term of this patent is extended or adjusted under 35 U.S.C. 154(b) by 0 days.

(21) Appl. No.: 16/116,926

(22) Filed: Aug. 30, 2018

(65) Prior Publication Data

US 2018/0374401 A1 Dec. 27, 2018

(30) Foreign Application Priority Data

Sep. 19, 2017 (CN) ..... 2017 1 0848489

(51) Int. Cl.
*G09F 9/302* (2006.01)
*G09G 3/36* (2006.01)

(52) U.S. Cl.
CPC ..... *G09F 9/3023* (2013.01); *G09G 3/3607* (2013.01); *G09G 3/3611* (2013.01); (Continued)

(58) Field of Classification Search
CPC .. G09F 9/3023; G09G 3/3607; G09G 3/3611; G09G 2300/0465; G09G 2310/0232
See application file for complete search history.

(56) References Cited

U.S. PATENT DOCUMENTS

2009/0309813 A1 12/2009 Fujita
2010/0214195 A1* 8/2010 Ogasawara ..... G02F 1/136286 345/55

FOREIGN PATENT DOCUMENTS

CN 101849255 A 9/2010
CN 205318057 A 6/2016
CN 105911744 A 8/2016

OTHER PUBLICATIONS

Office Action dated Jun. 14, 2019 of Chinese Patent Application No. 201710848489.1.

* cited by examiner

*Primary Examiner* — Abhishek Sarma
(74) *Attorney, Agent, or Firm* — Kilpatrick Townsend & Stockton LLP

(57) ABSTRACT

A profiled display panel is provided, the display region thereof has profiled border. The profiled display panel comprises low-brightness pixels and regular pixels. The pixels form pixel rows and pixel columns. The pixel row or column comprises pixel group comprising first and second pixel group. The number of pixels adjacent to the profiled border in first pixel group is greater than that of in second pixel group. The number of the low-brightness pixels in first pixel group is greater than or equal to that of in second pixel group. The wiring direction of the data line is second direction. The pixel comprises at least three sub-pixels. An aperture height of the sub-pixels in the low-brightness pixel is smaller than that of in the regular pixel along second direction. An aperture area of the low-brightness pixel is gradually increased in a direction from the profiled border to the display region.

11 Claims, 5 Drawing Sheets

(52) U.S. Cl.
CPC ..... *G09G 2300/0465* (2013.01); *G09G 2310/0232* (2013.01)

PROFILED DISPLAY PANEL AND DISPLAY DEVICE

CROSS-REFERENCE TO RELATED APPLICATIONS

The present disclosure claims priority to Chinese Patent Application No. 201710848489.1, filed on Sep. 19, 2017, the content of which is incorporated herein by reference in its entirety.

TECHNICAL FIELD

The present disclosure relates to the field of semiconductor technologies, and particularly, to a profiled display panel and a display device.

BACKGROUND

With the application of display technology in an intelligent wear and other portable electronic devices, there has been a diversified demand for the appearance of the display panel, and then a profiled display panel appears accordingly.

Compared with the conventional display panel, the main difference of the profiled display panel lies in that its display region presents a non-rectangular special shape, such as a circle, a ring, a diamond, etc., while the pixel units in the display panel are mostly rectangular structures or other relatively conventional structures. Therefore, when applied to the profiled display panel, the pixel unit and the profiled border line of the display panel may not fully fit in the profiled border region near the display panel, which may cause the display region of the display panel near the profiled border to present jagged patterns, the pattern of the border position are not smooth, thereby affecting the display effect of the display region near the profiled border.

Therefore, there is a need to provide a profiled display panel and a display device to solve the urgent problem of the display jagged phenomenon in the profiled display panel.

SUMMARY

In view of the above, the present disclosure provides a profiled display panel and a display device, which can solve the above mentioned problem.

In order to solve the above problem, the present disclosure provides a profiled display panel comprising a display region which has a profiled border, the profiled display panel comprises a plurality of pixels comprising low-brightness pixels and regular pixels, and brightness of the low-brightness pixels is lower than brightness of the regular pixels under a same driving voltage, the plurality of pixels forms a plurality of pixel rows extending in a first direction and a plurality of pixel columns extending in a second direction, each of the pixel rows or the pixel columns comprises a pixel group comprising low-brightness pixels at one end of the pixel group and regular pixels at the other end of the pixel group, and the regular pixels are arranged away from the profiled border, and the first direction intersects with the second direction; the pixel group comprises a first pixel group and a second pixel group, and a number of pixels adjacent to the profiled border in the first pixel group is greater than a number of pixels adjacent to the profiled border in the second pixel group, and a number of the low-brightness pixels in the first pixel group is greater than or equal to a number of the low-brightness pixels in the second pixel group; the profiled display panel further comprises a data line, and a wiring direction of the data line is the second direction, each of the plurality of pixels comprises at least three sub-pixels having different colors, and in a pixel group comprising the low-brightness pixels, an aperture height of sub-pixels in the low-brightness pixel is smaller than an aperture height of sub-pixels in the regular pixel along the second direction; and in a same pixel group, an aperture area of the low-brightness pixels is gradually increased in a direction from the profiled border toward the display region.

Further, in order to solve the above problem, the present disclosure provides a display device, including the above profiled display panel.

Compared to the related art, the profiled display panel and display device can bring the following beneficial effects:

In the profiled display panel and display device, the profiled display panel includes low-brightness pixels and regular pixels, the brightness of the low-brightness pixels is lower than the brightness of the regular pixels. By arranging low-brightness pixels at the display region close to the profiled border, the jagged display phenomenon can be alleviated. In a same pixel group, since the aperture area of the sub-pixels in the low-brightness pixel is gradually increased in a direction from the profiled border to the display region, the brightness of the low-brightness pixels is gradually increased as well, thereby achieving gradual transition of the brightness from low to high in the direction from the profiled border to the display region, and thus there is no significant brightness difference in the display region.

The present disclosure will be more apparent by the detailed description of the exemplary embodiments with reference to the accompanying drawings.

BRIEF DESCRIPTION OF DRAWINGS

The accompanying drawings, which are incorporated in and constitute a part of the specification, illustrate embodiments of the present disclosure and, together with the description, serve to explain principles of the present disclosure.

DESCRIPTION OF EMBODIMENTS

Figure 1:
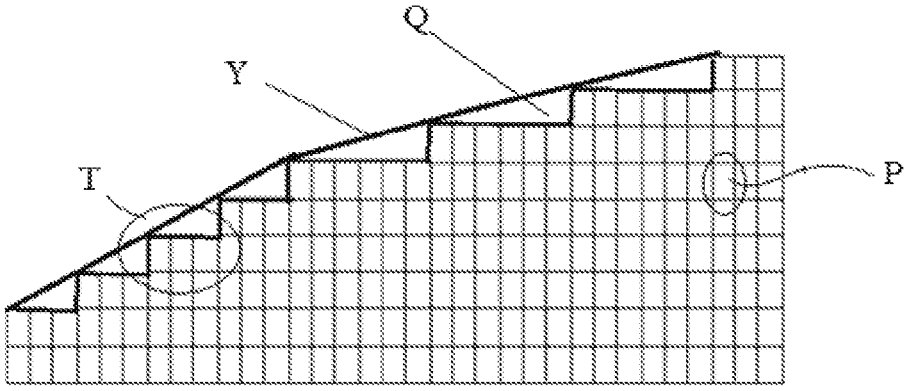
FIG. 1 (Related art)
FIG. 1 is a schematic diagram of a part of pixels of a profiled display panel in the related art.

Various exemplary embodiments of the present disclosure will be described in detail with reference to the accompanying drawings. It should be noted that relative arrangements of the components and steps, numerical expressions and numerical values set forth in the embodiments are not intended to limit the scope of the present disclosure, unless otherwise specified.

The following description for at least one exemplary embodiment is merely illustrative, and is in no way to limit the present disclosure and its application or use.

In all of the examples shown and discussed herein, any specific values are to be construed as illustrative only and not as a limitation. Thus, other examples of the exemplary embodiments may have different values.

It should be noted that similar reference numerals and letters indicate similar items in the following accompanying drawings, and therefore, once an item is defined in one drawing, it is not required to be further discussed in the subsequent accompanying drawings.

FIG. 1 is a schematic diagram of some pixels of a profiled display panel in the related art. As shown in FIG. 1, in order to fit a profiled border Y of the profile display panel, a part of the pixel P near the profiled border Y is removed, causing the display region to form a plurality of step regions T near the profiled border Y A region Q between the profiled border Y and the step region T may not arrange a complete pixel and is blocked by a black matrix (BM). The pixel P located in the step region T is lighted when displaying, while the black matrix in the region Q is almost opaque and the brightness is zero. Therefore, the brightness difference between the step region T and the region Q is large to form jagged patterns, and the pattern of the profiled border Y is not smooth during the display, affecting the display effect of the display panel. For example, a part of the display region of the display panel is hollowed to arrange a camera or a receiver, and the hollowed part is in a shape of a chamfered rectangle, a circle or an ellipse, etc., so that the display region has a profiled border. For another example, the display panel itself is a non-rectangular display panel such as a chamfered rectangular display panel, a circular display panel, or an annular display panel, in which the phenomenon of jagged patterns occurs.

With the profiled display panel provided by the present disclosure including low-brightness pixels and regular pixels, by designing and adjusting the aperture height of the sub-pixels in the low-brightness pixels near the profiled border, the brightness of the low-brightness pixels being smaller than that of the regular pixels is achieved, the brightness difference between the step region and the profiled border region is reduced, the jagged phenomenon of the display panel is alleviated. The profiled display panel provided by the present disclosure can be applied to a liquid crystal display panel or an organic light emitting display panel.

Figure 2:
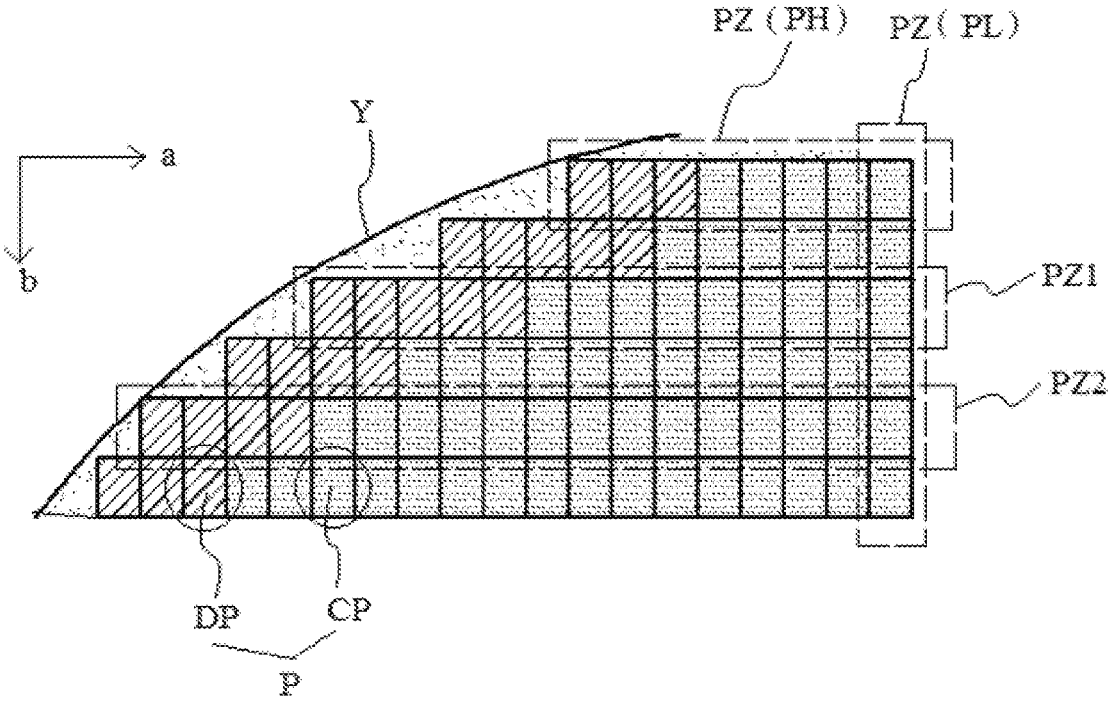
FIG. 2 is a top view of a profiled display panel according to an embodiment of the present disclosure.

FIG. 2 is a top view of a profiled display panel according to an embodiment of the present disclosure. As shown in FIG. 2, a display region of the profiled display panel has a profiled border Y. The profiled display panel includes a plurality of pixels P, and the pixels P include low-brightness pixels DP and regular pixels CP. The brightness of the low-brightness pixel DP is smaller than the brightness of the regular pixel CP under the same driving voltage. The plurality of pixels P form a plurality of pixel rows PH extending in the first direction a and a plurality of pixel columns PL in the second direction b. The first direction a intersects with the second direction b. The pixel row PH or the pixel column PL includes a pixel group PZ. The pixel group PZ serves as a part of the pixel row PH or the pixel column PL, and includes the low-brightness pixel DP at one end of the pixel group PZ and the regular pixel CP at the other end of the pixel group PZ. The regular pixel CP is arranged away from the profiled border Y. The present disclosure does not limit the number of pixels in the pixel group PZ. The regular pixel CP is arranged away from the profiled border Y compared to the low-brightness pixel DP. The space region between the profiled border Y and the low-brightness pixel DP is almost opaque and the brightness is zero. The brightness of the low-brightness pixel DP is lower than that of the regular pixel CP. Compared with the display panel, the brightness difference between the display region near the profiled border Y and the brightness of the profiled border Y is reduced, thereby alleviating the display jagged phenomenon at the profiled edge. In order to achieve a gradual smooth transition of the brightness, in the pixel group PZ including the low-brightness pixel DP, the number of low-brightness pixels DP may be larger than the number of pixels adjacent to the profiled border Y, that is, there are low-brightness pixels DP not being adjacent to the profiled border Y in the display panel.

As shown in FIG. 2, the pixel group PZ includes a first pixel group PZ1 and a second pixel group PZ2. The number of pixels P adjacent to the profiled border Y in the first pixel group PZ1 is greater than the number of pixels P adjacent to the profiled border Y in the second pixel group PZ2. The number of the low-brightness pixels DP in the first pixel group PZ1 is greater than or equal to the number of the low-brightness pixels DP in the second pixel group PZ2. In the present disclosure, The greater the number of pixels P adjacent to the profiled border Y in the pixel group PZ is, the greater the number of low-brightness pixels DP in the pixel group PZ will be. In one embodiment, the number of low-brightness pixels DP in one pixel group is greater than or equal to the number of the pixel P adjacent to the profiled border Y, the border shape displayed in the display region near the profiled border Y is closer to the shape of the profiled border Y, which weakens the phenomenon of the jagged border during the display.

Figure 3:
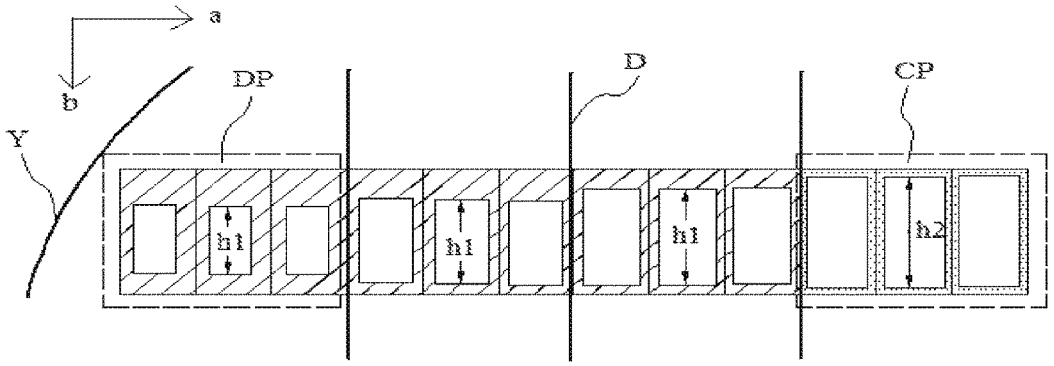
FIG. 3 is a schematic diagram of a pixel group of a profiled display panel according to an embodiment of the present disclosure.

The profiled display panel includes a data line. The direction of the data line is a second direction. The pixel includes at least three sub-pixels having different colors. In the pixel group including the low-brightness pixel, an aperture height of the sub-pixels in the low-brightness pixel is smaller than an aperture height of the sub-pixels in the regular pixel along the second direction. In a same pixel group, an aperture area of the low-brightness pixel gradually increases in a direction from the profiled border to the display region. FIG. 3 is a schematic diagram of a pixel group of a profiled display panel according to an embodiment of the present disclosure. Taking a pixel group in one pixel row as an example in FIG. 3 in which the pixel P includes three sub-pixels having different colors, the wiring direction of the data line D is a second direction b. In the second direction b, the aperture height h1 of the sub-pixels in the low-brightness pixel DP is smaller than the aperture height h2 of the sub-pixels in the regular pixel CP. In the pixel group, an aperture area of the low-brightness pixel DP gradually increases in a first direction a from the profiled border Y to the display region.

In the present disclosure, the aperture heights h1 of the respective sub-pixels in a same low-brightness pixel DP may be the same or different, but are all smaller than the aperture heights h2 of the sub-pixels in the regular pixel CP. The aperture areas of the respective sub-pixels in a same low-brightness pixel DP may also be the same or different. Taking a liquid crystal display panel as an example, the liquid crystal display panel includes a black matrix, and the black matrix divides the display panel into a plurality of sub-pixels, therefore the aperture height of the sub-pixels in the low-brightness pixel DP being smaller than the aperture height of the sub-pixels in the regular pixel CP can be realized by adjusting the width of the black matrix surrounding the sub-pixels along the second direction. And the aperture area of the low-brightness pixel DP being smaller than the aperture area of the regular pixel CP is thus realized so that the brightness of the low-brightness pixel DP is smaller than the brightness of the regular pixel CP. In the present disclosure, the aperture areas of the sub-pixels being different is realized by adjusting the black matrix surrounding the sub-pixels, thereby realizing that the brightness of the low-brightness pixel is smaller than that of the regular pixel, and the process is simple and easy to implement.

With the profiled display panel including low-brightness pixels and regular pixels according to the present disclosure, the brightness of the low-brightness pixel is smaller than the brightness of the regular pixel, the low-brightness pixels are arranged in the display region near the profiled border to alleviate the phenomenon of the jagged display of the profiled border. In a same pixel group, an aperture area of the low-brightness pixel is gradually increased in a direction from the profiled border to the display region so that the brightness of the low-brightness pixel is gradually increased, and the gradual transition of the brightness from low to high in the direction from the profiled border to the display region is realized, and there is no large brightness difference in the display region.

Figure 4:
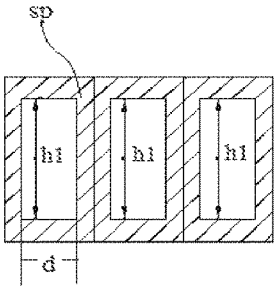
FIG. 4 is a schematic diagram of a low-brightness pixel according to an embodiment of the present disclosure.

Further, in some embodiments, FIG. 4 is a schematic diagram of a low-brightness pixel according to an embodiment of the present disclosure. As shown in FIG. 4, in a low-brightness pixel, the aperture areas of the respective sub-pixels sp having different colors are the same, and the aperture heights h1 of the sub-pixels sp having different colors are the same.

In the profiled display panel according to the embodiments of the present disclosure, if the aperture areas of the respective sub-pixels sp having different colors in the low-brightness pixels are the same, there is no mixed color difference between the low-brightness pixels and the regular pixels when the display panel is displaying, and the display panel has no color-shift phenomenon. Meanwhile, in a low-brightness pixel, if the aperture heights h1 of the respective sub-pixels sp having different colors are the same, the aperture shapes of the respective sub-pixels sp having different colors are the same, and the process for manufacturing the display panel is relatively simple. The aperture width d of the sub-pixel sp in the low-brightness pixel may be less than or equal to the aperture width of the sub-pixel in the regular pixel. For example, in a liquid crystal display panel, when the aperture width d of the sub-pixel in the low-brightness pixel is equal to the aperture width of the sub-pixel in the regular pixel, the difference of the aperture area of the sub-pixel can be realized by only adjusting the size of the black matrix in the direction of the aperture height of the sub-pixel during manufacturing of the display panel.

Figure 5:
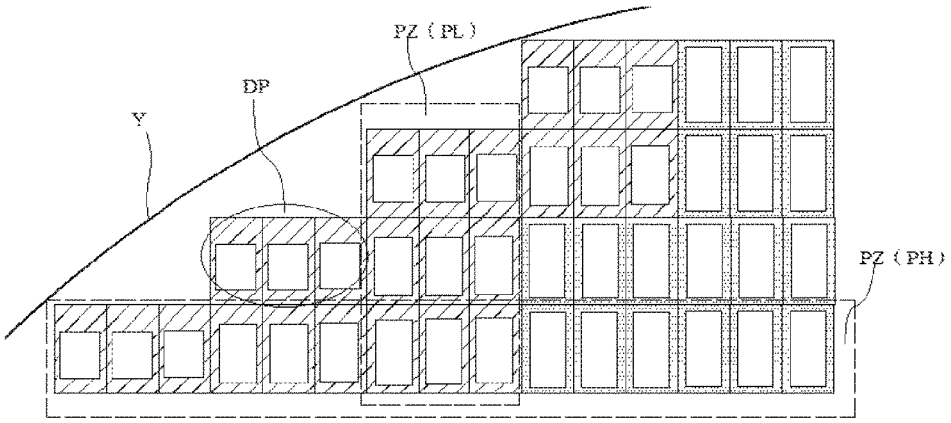
FIG. 5 is a top view of a profiled display panel according to an embodiment of the present disclosure.

Further, in some embodiments, FIG. 5 is a top view of a profiled display panel according to an embodiment of the present disclosure. As shown in FIG. 5, in a low-brightness pixel, the aperture areas of the respective sub-pixels having different colors are the same, and the aperture widths of the respective sub-pixels having different colors are the same. In a same pixel group PZ in a pixel row PH or a pixel column PL, the aperture heights of the sub-pixels of the different low-brightness pixels DP is gradually increased from the profiled border Y to the display region.

In some embodiments, the low-brightness pixels of the profiled display panel arranged near the profiled border alleviate the jagged phenomenon. In the low-brightness pixels, the aperture areas of the respective sub-pixels having different colors are the same, and the display panel has no color-shift phenomenon. In a direction from the profiled border to the display region, the aperture heights of the sub-pixels of different low-brightness pixels are gradually increased. Therefore, the gradual transition of the brightness of the low-brightness pixels from low to high is realized, and there is no large brightness difference during the display, and the visual effect is good.

Figure 6:
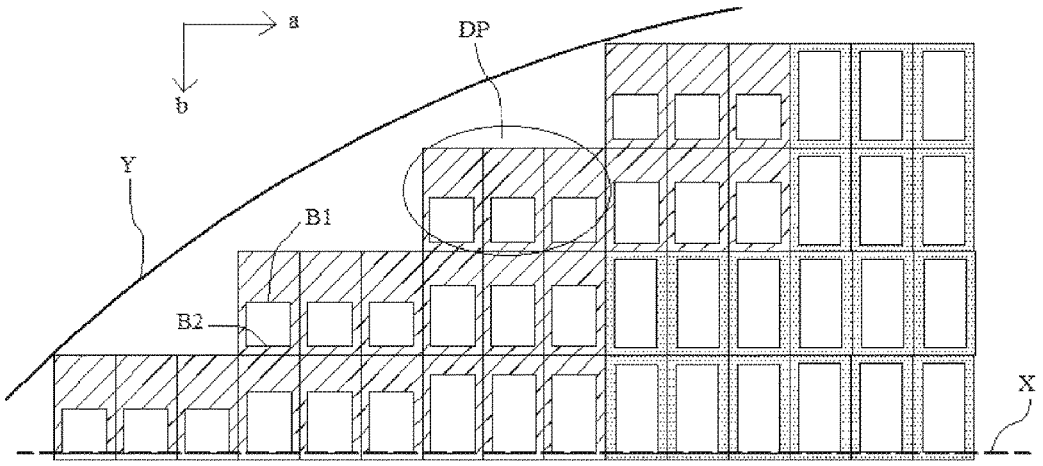
FIG. 6 is a top view of a profiled display panel according to another embodiment of the present disclosure.

Further, in some embodiments, FIG. 6 is a top view of a profiled display panel according to another embodiment of the present disclosure. As shown in FIG. 6, in the second direction b, the aperture of the sub-pixel has an first edge B1 and a second edge B2 opposite to the first edge B1, the second edge B2 is away from the profiled border Y with respect to the first edge B1, and the second edges B2 of the sub-pixels located in a same straight line in the first direction a is located in the same straight line X. In an embodiment of the present disclosure, the aperture region of the sub-pixel of the low-brightness pixel DP is closer to the display region relative to the profiled border. For example, in the liquid crystal display panel, when the display panel is manufactured, only the width of the black matrix on the side of the sub-pixel near the profiled border Y needs to be adjusted in the second direction b to realize the adjustment for the aperture area of the sub-pixel, and the process is relatively simple and easy to implement.

Figure 7:
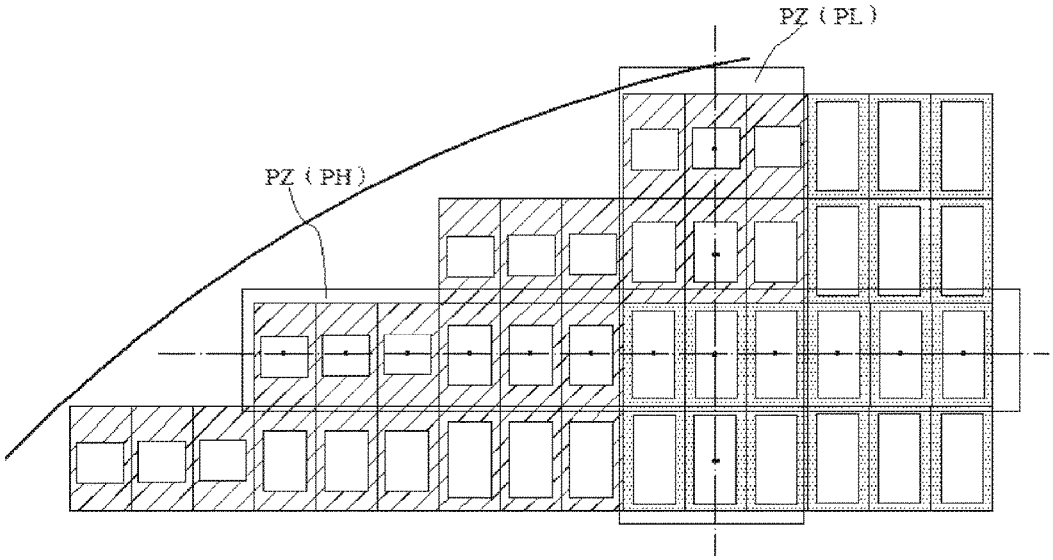
FIG. 7 is a top view of a profiled display panel according to another embodiment of the present disclosure.

Further, in some embodiments, FIG. 7 is a top view of a profiled display panel according to another embodiment of the present disclosure. As shown in FIG. 7, in a low-brightness pixel, the respective sub-pixels having different colors have the same aperture area, and have the same aperture width. In a same pixel group PZ in a pixel row PH or a pixel column PL, the centers of the aperture regions of the respective sub-pixels are located in a same straight line.

In the embodiments, the low-brightness pixels of the profiled display panel arranged near the profiled border alleviate the jagged phenomenon. Meanwhile, the respective sub-pixels having different colors have the same aperture area, and the display panel has no color-shift phenomenon. In a same pixel group, the centers of the aperture regions of the respective sub-pixels is located in a same straight line, ensuring that the center position of the sub-pixel remains unchanged, and the apertures of the sub-pixels are uniformly distributed in the display panel, and the visual effect is good.

Figure 8:
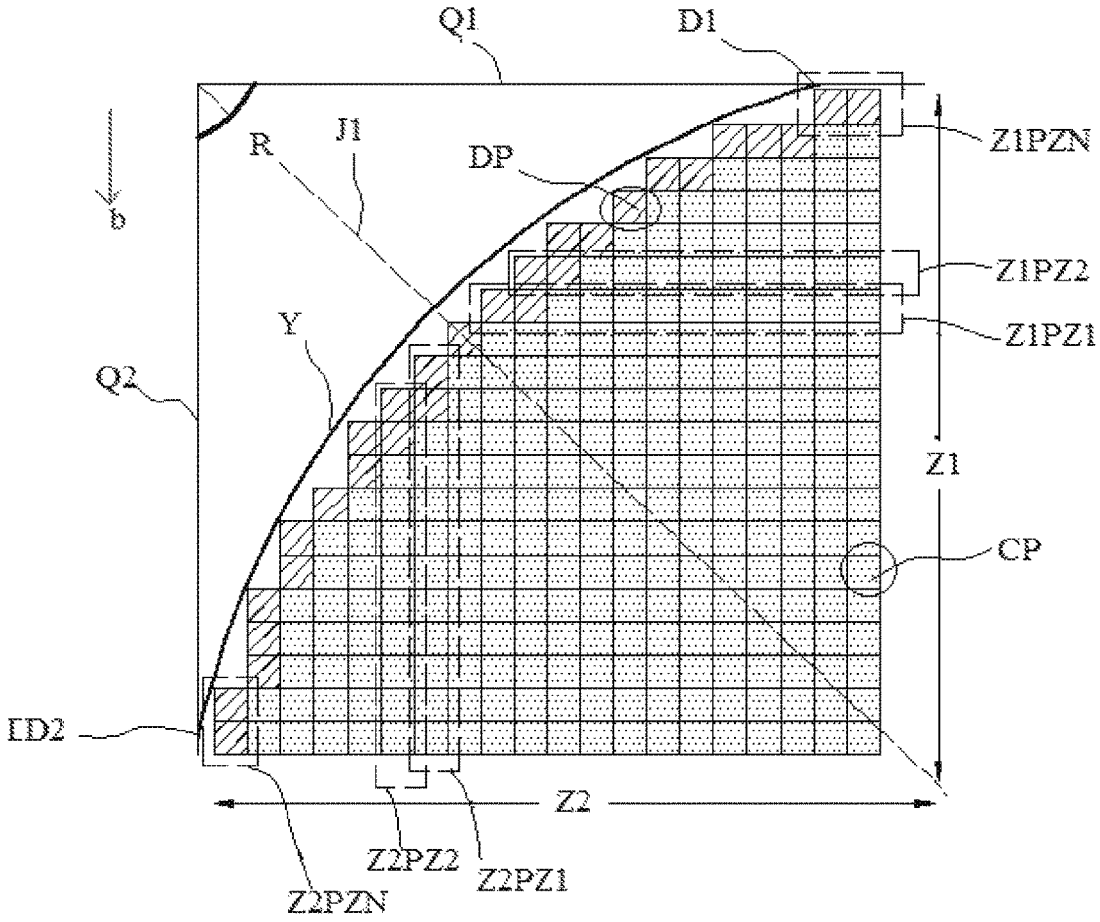
FIG. 8 is a top view of a profiled display panel according to another embodiment of the present disclosure.

Further, in some embodiments, FIG. 8 is a top view of a profiled display panel according to another embodiment of the present disclosure. As shown in FIG. 8, the profiled display panel includes low-brightness pixels DP and regular pixels CP. A profiled border Y is an arcuate border. The first tangent line Q1 of the arcuate border intersects with the second tangent line Q2 of the arcuate border to form an angle R toward the arcuate border. The first tangent line Q1 is a tangent line passing through a first end point D1 of the arcuate border, and the second tangent line Q2 is a tangent line passing through a second end point D2 of the arcuate border. A display region between an angle bisector J1 of the angle R and the first tangent line Q1 is a first region Z1. A display region between the angle bisector J1 of the angle R and the second tangent line Q2 is a second region Z2. In the first region Z1, each of the pixel groups is located in a same pixel row, and in the second region Z2, each of the pixel groups is located in a same pixel column. In a direction from the angle bisector J1 of the angle R to the first tangent line Q1, the first region Z1 includes a first pixel group Z1PZ1 of the first region, a second pixel group Z1PZ2 of the first region to an $N^{th}$ pixel group Z1PZN of the first region arranged sequentially. In a direction from the angular bisector J1 of the angle R to the second tangent line Q2, the second region Z2 includes a first pixel group Z2PZ1 of the second region, a second pixel group Z2PZ2 of the second region to an $N^{th}$ pixel group Z2PZN of the second region arranged sequentially. In a direction from the profiled border to the display region, the aperture heights of the sub-pixels in the respective pixels in an $X^{th}$ pixel group of the first region and in an $X^{th}$ pixel group of the second region are the same, and X is greater than or equal to 1 and less than or equal to N. and N is a positive integer. Only an arrangement manner of the pixels P in the profiled display panel is shown in FIG. 8, and the sub-pixels included in the pixel P are not shown in FIG. 8.

In the embodiments, adjusting of the aperture area of the sub-pixel is realized by adjusting the aperture height of the sub-pixels along the second direction b in the low-brightness pixel, thereby ensuring that the aperture area of the low-brightness pixel in a same pixel group is gradually increased in a direction from the profiled border to the display region. In the embodiments, the profiled border of the profiled display panel is an arcuate border, and the display region near the profiled border is designed with partitions. In a direction from the profiled border to the display region, the aperture heights of the sub-pixels in the respective pixels in an $X^{th}$ pixel group of the first region and in an $X^{th}$ pixel group of the second region are the same, that is, the brightness of the respective pixels in the $X^{th}$ pixel group of the first region and in an $X^{th}$ pixel group of the second region are the same accordingly. The shape of the border pattern of the display region near the profiled border during the display is closer to the shape of the arcuate border, which weakens the display jagged phenomenon caused by the profiled border, and at the same time the transition manners of the pixel brightness in the two regions of the angle bisector of the angle R are the same, and the visual effect is good when the display panel is displaying.

Figure 9:
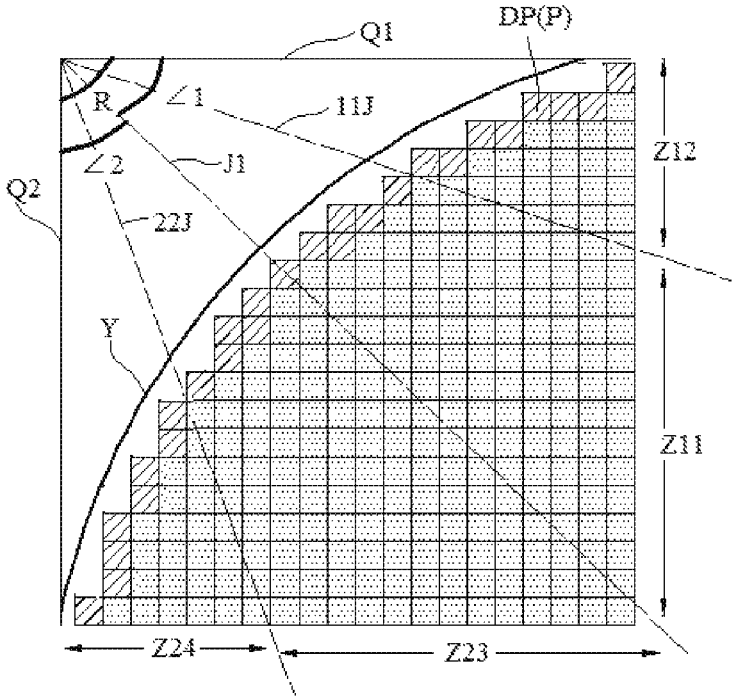
FIG. 9 is a top view of a profiled display panel according to another embodiment of the present disclosure.

Further, in some embodiments, FIG. 9 is a top view of a profiled display panel according to another embodiment of the present disclosure. As shown in FIG. 9, the angle bisector of the angle R divides the angle R into a first angle ∠1 with the first tangent line Q1 as an edge and a second angle ∠2 with the second tangent line Q2 as an edge. The angle bisector 11J of the first angle ∠1 divides the first region into a first sub-region Z11 near the angular bisector J1 of the angle R and a second sub-region Z12 near the first tangent line Q1, the number of the pixels P adjacent to the profiled border Y in the pixel group in the second sub-region Z12 is greater than or equal to the number of the pixels P adjacent to the profiled border Y in the pixel group in the first sub-region Z11. The angle bisector 22J of the second angle ∠2 divides the second region into a third sub-region Z23 near the angular bisector J1 of the angle R and a fourth sub-region Z24 near the second tangent line Q2, the number of the pixels P adjacent to the profiled border Y in the pixel group in the fourth sub-region Z24 is greater than or equal to the number of the pixels P adjacent to the profiled border Y in the pixel group in the third sub-region Z23.

In the embodiments, in the first sub-region Z11 and the third sub-region Z23 near the angle bisector J1 of the angle R, the arcuate shape of the profile border is more noticeable. If the number of pixels P in the pixel group adjacent to the profile border Y is less, the brightness transition of the profiled border is finer, the display jagged phenomenon caused by the profiled border is weakened, and the presented border shape during the display is closer to an arcuate shape. The second sub-region Z12 and the fourth sub-region Z24 are respectively close to two end points near the profiled border. The border in the display panel connected with the two end points of the profiled border is a regular border, the visual arcuate extent at the profiled border is less noticeable than that in the first sub-region Z11 and the third sub-region Z23, and more pixels can be arranged adjacent to the profiled border.

Further, in some embodiments, as shown in FIG. 9, the number of pixels P adjacent to the profiled border Y in the pixel group in the first sub-region Z11 is less than or equal to 2, and the number of the low-brightness pixels DP in the pixel group in the first sub-region Z11 is less than or equal to 2. The number of pixels P adjacent to the profiled border Y in the pixel group in the second sub-region Z12 is greater than or equal to 2, and the number of low-brightness pixels DP in the pixel group in the second sub-region Z12 is greater than or equal to 2.

In the embodiments, in a pixel group including low-brightness pixels, the number of low-brightness pixels is greater than or equal to the number of pixels in the pixel group adjacent to the profiled border, which reduces the brightness difference between the display area and the profiled border area, and weakens the display jagged phenomenon.

Further, in some embodiments, as shown in FIG. 9, in the respective pixel group of the second sub-region Z12, the number of pixels P adjacent to the profiled border Y is equal to the number of the low-brightness pixels DP. In the pixel group of the second sub-region, the number of pixels adjacent to the profiled border is relatively large, and all the pixels adjacent to the profiled border are arranged as low-brightness pixels, therefore the display jagged phenomenon is weakened, and at the same time the brightness of the low-brightness pixels is gradually increased in the direction from the profiled border to the display region, thereby realizing a uniform transition of the brightness and a good display effect of the display panel.

Further, in some embodiments, the difference of the gray scale between the low-brightness pixels having different brightness is an integer multiple of 16 in the profiled display panel provided by the present disclosure.

When the display panel is displaying, the brightness change from the darkest to the brightest has a total of 256 brightness levels from 0 to 255, which is called 256 gray scales. In the embodiments, 14 low-brightness pixels in which the gray scales differs by an integer multiple of 16 are pre-designed by adjusting the aperture area of the sub-pixels in the pixel. The pixel with the lowest brightness in the low-brightness pixels is 15 grayscale, and the pixel with the highest brightness in the low-brightness pixels is 239 grayscale. The required low-brightness pixels arranged are selected according to the brightness requirement at a position adjacent to the profiled border. At this time, the aperture area of the sub-pixel in the pixels has been designed, thereby saving the time for re-designing the process. Designing the gray scale differing an integer multiple of 32 only requires to design 6 low-brightness pixels. The number of low-brightness pixels of different brightness is too little to meet the different brightness requirements of adjacent pixels at the profiled border. Designing the gray scale differing an integer multiple of 8 requires to design 30 low-brightness pixels. The number of low-brightness pixels with different brightness is relatively big and the design is relatively complicated. In the embodiments of the present disclosure, 14 kinds of low-brightness pixels with different brightness are designed, the design is relatively simple, and the more brightness changes of the low-brightness pixels can be realized at the same time.

It should be noted that the values of the difference in the gray scale between the low-brightness pixels with different brightness in the profiled display panel can be designed according to different brightness requirements. In the above embodiments, the case where the gray scales of the difference between the low-brightness pixels with different brightness being an integer multiple of 16 is an implementation and is not intended to limit the scope of the present disclosure.

Figure 10:
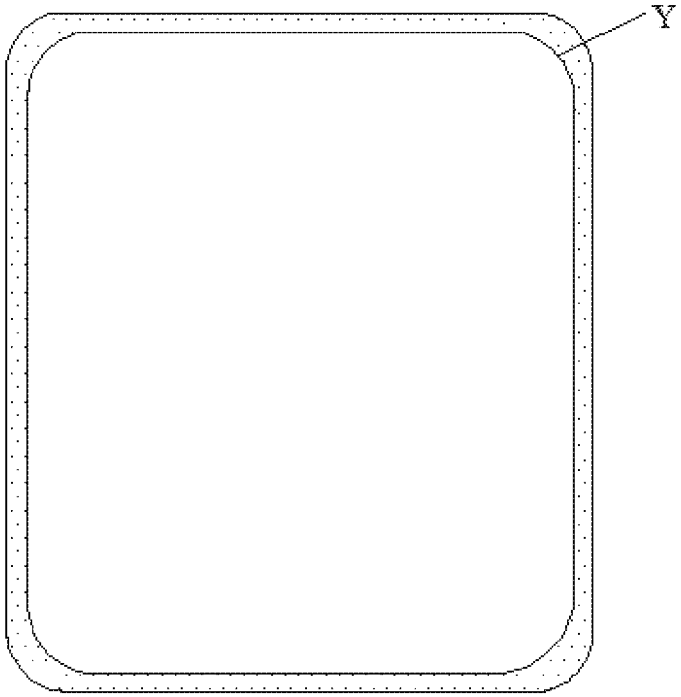
FIG. 10 is a top view of a display device according to an embodiment of the present disclosure.

Further, the present disclosure further provides a display device, including any of the profiled display panels provided by the embodiments of the present disclosure. FIG. 10 is a top view of a display device according to an embodiment of the present disclosure. As shown in FIG. 10, the display device includes a profiled display panel having an arcuate border Y. With the display device provided by the present disclosure, the profiled display panel includes low-brightness pixels and regular pixels, the low-brightness pixels are arranged in a display region near the profiled border, and the aperture area of the sub-pixel is adjusted to realize different electric filed intensity generated after applying the same voltage, and further realize the different transmittance in the pixels. The brightness of the low-brightness pixel is smaller than that of the regular pixel, therefore the display jagged phenomenon of the profiled border is alleviated. Meanwhile, the brightness of the low-brightness pixel gradually increases in a direction from the profiled border to the display region, thereby realizing a gradual transition of the brightness from low to high in the direction from the profiled border to the display region.

It can be seen from the above embodiments that the profiled display panel and the display device of the present disclosure achieve the following beneficial effects:

With the profiled display panel and the display device provided by the present disclosure, the profiled display panel includes low-brightness pixels and regular pixels, and the brightness of the low-brightness pixels is smaller than the brightness of the regular pixels. Arranging the low-brightness pixels in the display region near the profiled border alleviates the display jagged phenomenon at the profiled border. In a same pixel group, if the aperture area of the sub-pixels in the low-brightness pixels is gradually increased in the direction from the profiled border to the display region, the brightness of the low-brightness pixels is gradually increased, thereby realizing the gradual transition of the brightness from low to high in the direction from the profiled border to the display region, and there is no big difference in brightness in the display region when displaying.

What is claimed is:

1. A profiled display panel, wherein the profiled display panel comprises:

a display region which has a profiled border, the profiled display panel comprises a plurality of pixels comprising low-brightness pixels and regular pixels, and brightness of the low-brightness pixels is lower than brightness of the regular pixels under a same driving voltage, the plurality of pixels forms a plurality of pixel rows extending in a first direction and a plurality of pixel columns extending in a second direction, each of the pixel rows or the pixel columns comprises a pixel group comprising low-brightness pixels at one end of the pixel group and regular pixels at the other end of the pixel group, and the regular pixels are arranged away from the profiled border, wherein the first direction intersects with the second direction;

the pixel group comprises a first pixel group and a second pixel group, and a number of pixels adjacent to the profiled border in the first pixel group is greater than a number of pixels adjacent to the profiled border in the second pixel group, and a number of the low-brightness pixels in the first pixel group is greater than or equal to a number of the low-brightness pixels in the second pixel group;

the profiled display panel further comprises a data line, and a wiring direction of the data line is the second direction, each of the plurality of pixels comprises at least three sub-pixels having different colors, and in a pixel group comprising the low-brightness pixels, an aperture height of sub-pixels in the low-brightness pixel is smaller than an aperture height of sub-pixels in the regular pixel along the second direction; and in a same pixel group, an aperture area of the low-brightness pixels is gradually increased in a direction from the profiled border toward the display region.

2. The profiled display panel according to claim 1, wherein in each of the low-brightness pixels, aperture areas of the sub-pixels having different colors are the same, and aperture heights of the sub-pixels having different colors are the same.

3. The profiled display panel according to claim 2, wherein in a same pixel group, aperture heights of sub-pixels of different low-brightness pixels are gradually increased in a direction from the profiled border toward the display region.

4. The profiled display panel according to claim 3, wherein in the second direction, an aperture of a sub-pixel has an first edge and a second edge opposite to the first edge, and the second edge is away from the profiled border compared to the first edge, and for the sub-pixels located in a same straight line in the first direction, second edges of the sub-pixels are located in a same straight line.

5. The profiled display panel according to claim 3, wherein in a same pixel group, centers of aperture regions of the sub-pixels are located in a same straight line.

6. The profiled display panel according to claim 1, wherein the profiled border is an arcuate border;

the arcuate border has a first tangent line and a second tangent line intersecting with the first tangent line to form an angle R toward the arcuate border, the first tangent line is a tangent line passing through a first end point of the arcuate border, and the second tangent line is a tangent line passing through a second end point of the arcuate border;

a display region between an angle bisector of the angle R and the first tangent line is a first region, and a display region between the angle bisector of the angle R and the second tangent line is a second region, wherein in the first region, one pixel group of the pixel groups is located in a same pixel row, and in the second region, one pixel group of the pixel groups is located in a same pixel column;

in a direction from the angle bisector of the angle R toward the first tangent line, the first region comprises a first pixel group of the first region, a second pixel group of the first region to an $N^{th}$ pixel group of the first region arranged sequentially, and in a direction from the angular bisector of the angle R toward the second tangent line, the second region comprises a first pixel group of the second region, a second pixel group of the second region to an $N^{th}$ pixel group of the second region arranged sequentially; and in a direction from the profiled border toward the display region, aperture heights of the sub-pixels in the pixels in an $X^{th}$ pixel group of the first region and aperture heights of the sub-pixels in the pixels in an $X^{th}$ pixel group of the second region are the same, wherein X is greater than or equal to 1 and less than or equal to N, and N is a positive integer.

7. The profiled display panel according to claim 6, wherein:

the angle bisector of the angle R divides the angle R into a first angle with the first tangent line as an edge and a second angle with the second tangent line as an edge;

an angle bisector of the first angle divides the first region into a first sub-region close to the angular bisector of the angle R and a second sub-region close to the first tangent line, a number of the pixels adjacent to the profiled border in the pixel group in the second sub-region is greater than or equal to a number of the pixels adjacent to the profiled border in the pixel group in the first sub-region; and an angle bisector of the second angle divides the second region into a third sub-region close to the angular bisector of the angle R and a fourth sub-region close to the second tangent line, a number of the pixels adjacent to the profiled border in the pixel group in the fourth sub-region is greater than or equal to a number of the pixels adjacent to the profiled border in the pixel group in the third sub-region.

8. The profiled display panel according to claim 7, wherein:

the number of pixels adjacent to the profiled border in the pixel group in the first sub-region is less than or equal to 2, and a number of low-brightness pixels in a pixel group in the first sub-region is less than or equal to 2;

the number of pixels adjacent to the profiled border in the pixel group in the second sub-region is greater than or equal to 2, and a number of low-brightness pixels in a pixel group in the second sub-region is greater than or equal to 2.

9. The profiled display panel according to claim 8, wherein:

in each of the pixel groups of the second sub-region, the number of pixels adjacent to the profiled border is equal to the number of the low-brightness pixels.

10. The profiled display panel according to claim 1, wherein a difference of gray scale between the low-brightness pixels having different brightness is an integer multiple of 16.

11. A display device comprising:

a profiled display panel, wherein the profiled display panel comprises:

a display region which has a profiled border, the profiled display panel comprises a plurality of pixels comprising low-brightness pixels and regular pixels, and brightness of the low-brightness pixels is lower than brightness of the regular pixels under a same driving voltage, the plurality of pixels forms a plurality of pixel rows extending in a first direction and a plurality of pixel columns extending in a second direction, each of the pixel rows or the pixel columns comprises a pixel group comprising low-brightness pixels at one end of the pixel group and regular pixels at the other end of the pixel group, and the regular pixels are arranged away from the profiled border, wherein the first direction intersects with the second direction;

the pixel group comprises a first pixel group and a second pixel group, and a number of pixels adjacent to the profiled border in the first pixel group is greater than a number of pixels adjacent to the profiled border in the second pixel group, and a number of the low-brightness pixels in the first pixel group is greater than or equal to a number of the low-brightness pixels in the second pixel group;

the profiled display panel further comprises a data line, and a wiring direction of the data line is the second direction, each of the plurality of pixels comprises at least three sub-pixels having different colors, and in a pixel group comprising the low-brightness pixels, an aperture height of sub-pixels in the low-brightness pixel is smaller than an aperture height of sub-pixels in the regular pixel along the second direction; and in a same pixel group, an aperture area of the low-brightness pixels is gradually increased in a direction from the profiled border toward the display region.

* * * * *